US007926595B1

(12) United States Patent
Wintill et al.

(10) Patent No.: US 7,926,595 B1
(45) Date of Patent: Apr. 19, 2011

(54) FILTER SUB

(75) Inventors: Charles David Wintill, Houston, TX (US); William John Darnell, Houston, TX (US); William Ryle Darnell, St. Martinville, LA (US); Rodney Wayne Long, Cypress, TX (US); Todd Ulrich Chretien, Lafayette, LA (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 12/821,620

(22) Filed: Jun. 23, 2010

(51) Int. Cl.
*E21B 43/34* (2006.01)
*E03B 3/18* (2006.01)

(52) U.S. Cl. ..... 175/314; 166/227

(58) Field of Classification Search ..... 166/56, 166/157, 105.5, 265, 227; 175/314; 210/97, 210/132, 314, 130, 170.7
See application file for complete search history.

(56) References Cited

U.S. PATENT DOCUMENTS

| | | | | |
|---|---|---|---|---|
| 7,243,740 | B2 * | 7/2007 | Frith | 175/107 |
| 2005/0121233 | A1 * | 6/2005 | Frith | 175/57 |
| 2009/0255878 | A1 * | 10/2009 | Himmel | 210/741 |

* cited by examiner

*Primary Examiner* — Shane Bomar
*Assistant Examiner* — Sonya Bible
(74) *Attorney, Agent, or Firm* — Buskop Law Group, PC; Wendy Buskop

(57) ABSTRACT

A downhole filter with a filter housing having a top filter and a bottom filter disposed therein. The filter housing can be in fluid communication with each filter. Each filter can be in fluid communication with a burst disk housing having a burst disk module and a burst disk. Each burst disk housing can be in fluid communication with the filter housing. Fluid can flow through the filter housing and through the filter. When a filter is clogged, the fluid can burst a burst disk, thereby bypassing the filter. The downhole filter can include a middle sub in fluid communication with the top filter and a second portion of the filter housing. The middle sub can threadably engage a bottom burst disk housing.

14 Claims, 5 Drawing Sheets

FILTER SUB

FIELD

The present embodiments generally relate to a downhole filter for hydraulic control lines.

BACKGROUND

A need exists for a downhole filter that provides redundancy. A further need exists for a downhole filter that can bypass a plugged filter.

The present embodiments meet these needs.

BRIEF DESCRIPTION OF THE DRAWINGS

The detailed description will be better understood in conjunction with the accompanying drawings as follows.

Figure 1A:
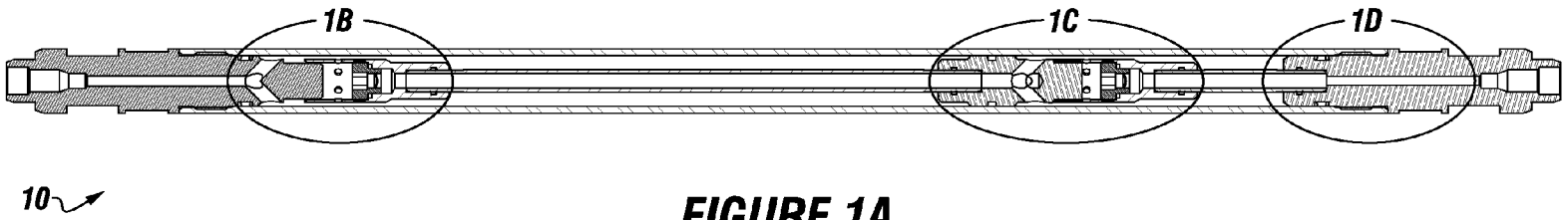
FIGS. 1A, 1B, 1C and 1D depict an embodiment of the downhole filter.
Figure 1B:
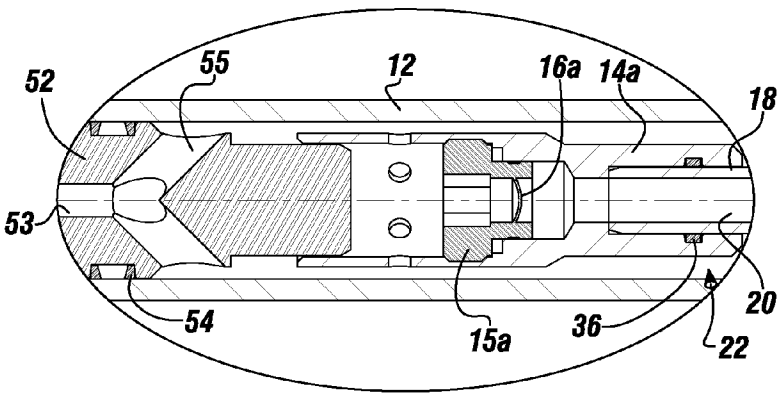
Figure 1C:
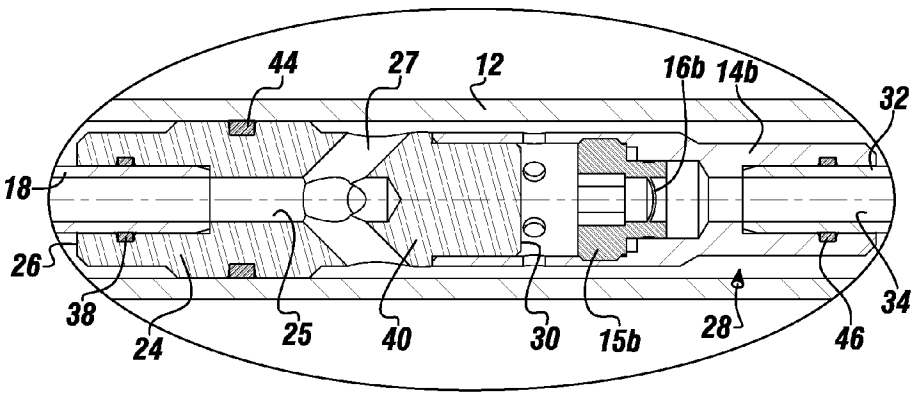
Figure 1D:
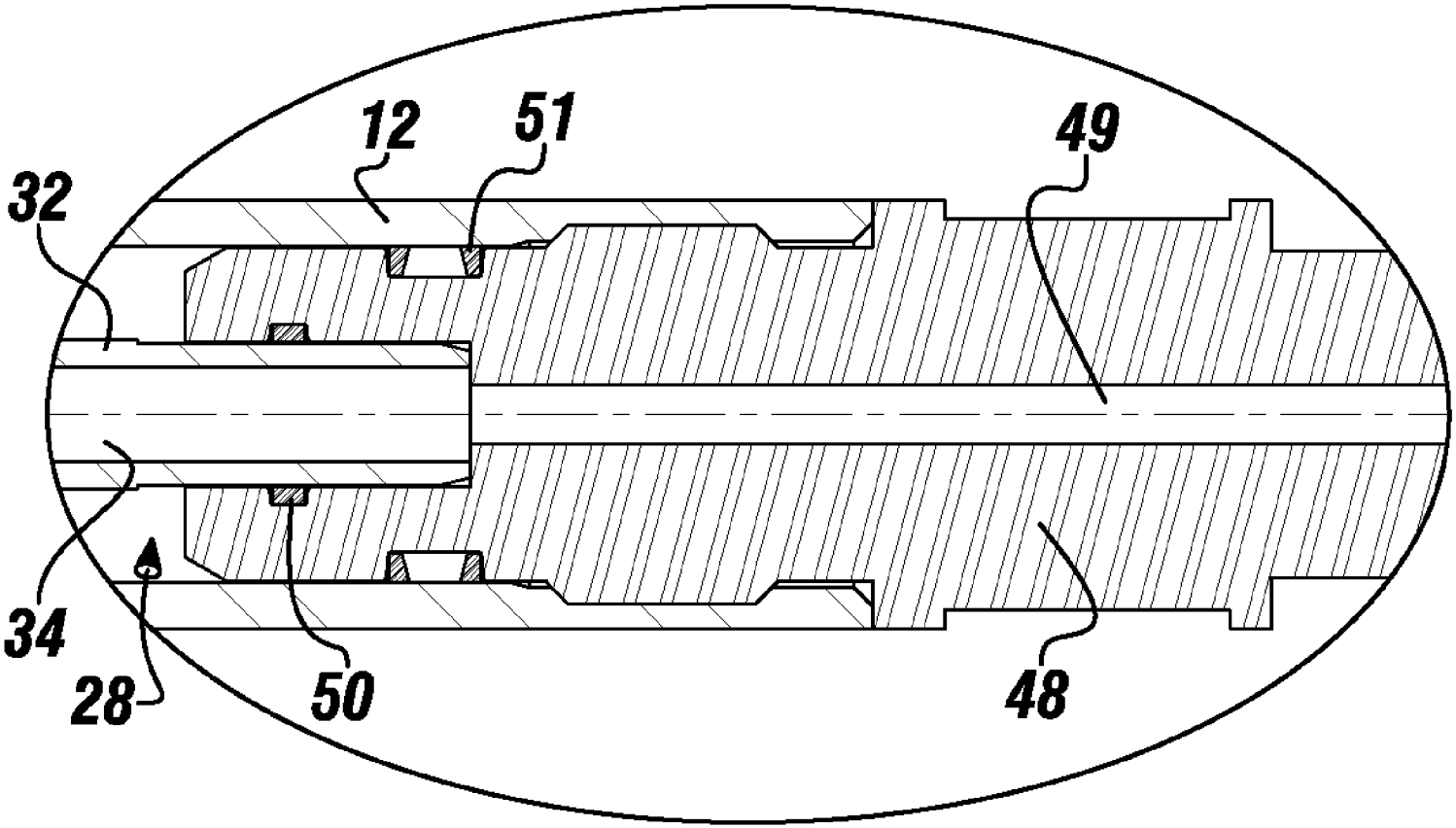
Figure 2A:
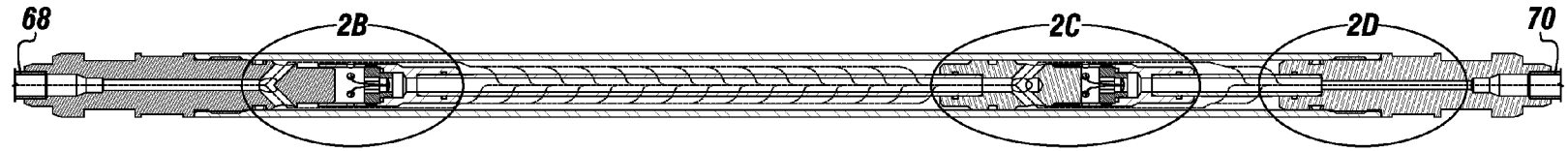
FIGS. 2A, 2B, 2C and 2D depict an embodiment of the downhole filter showing various flow paths.
Figure 2B:
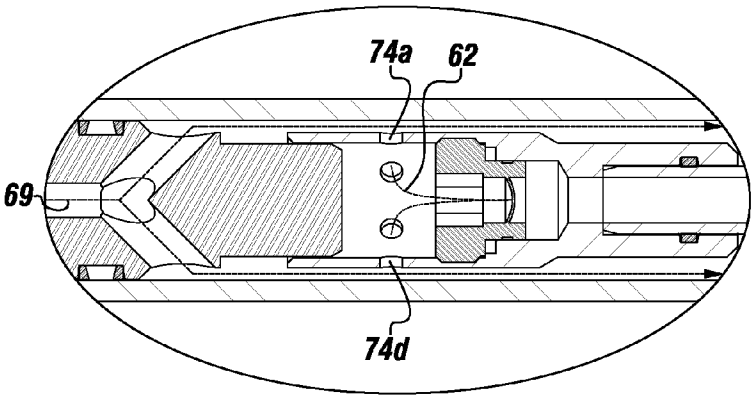
Figure 2C:
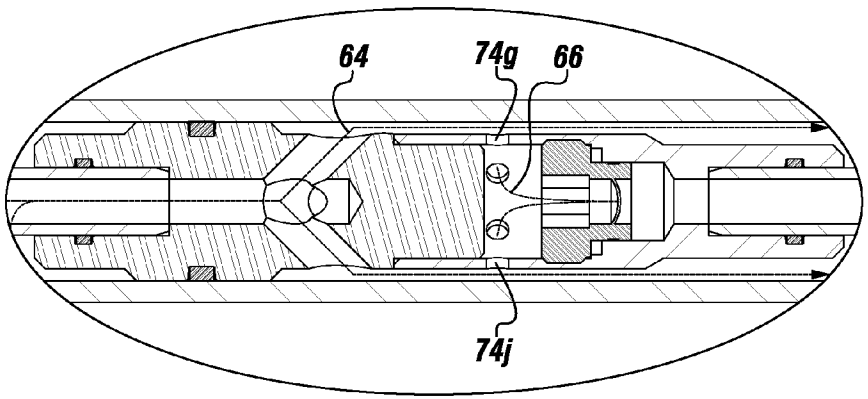
Figure 2D:
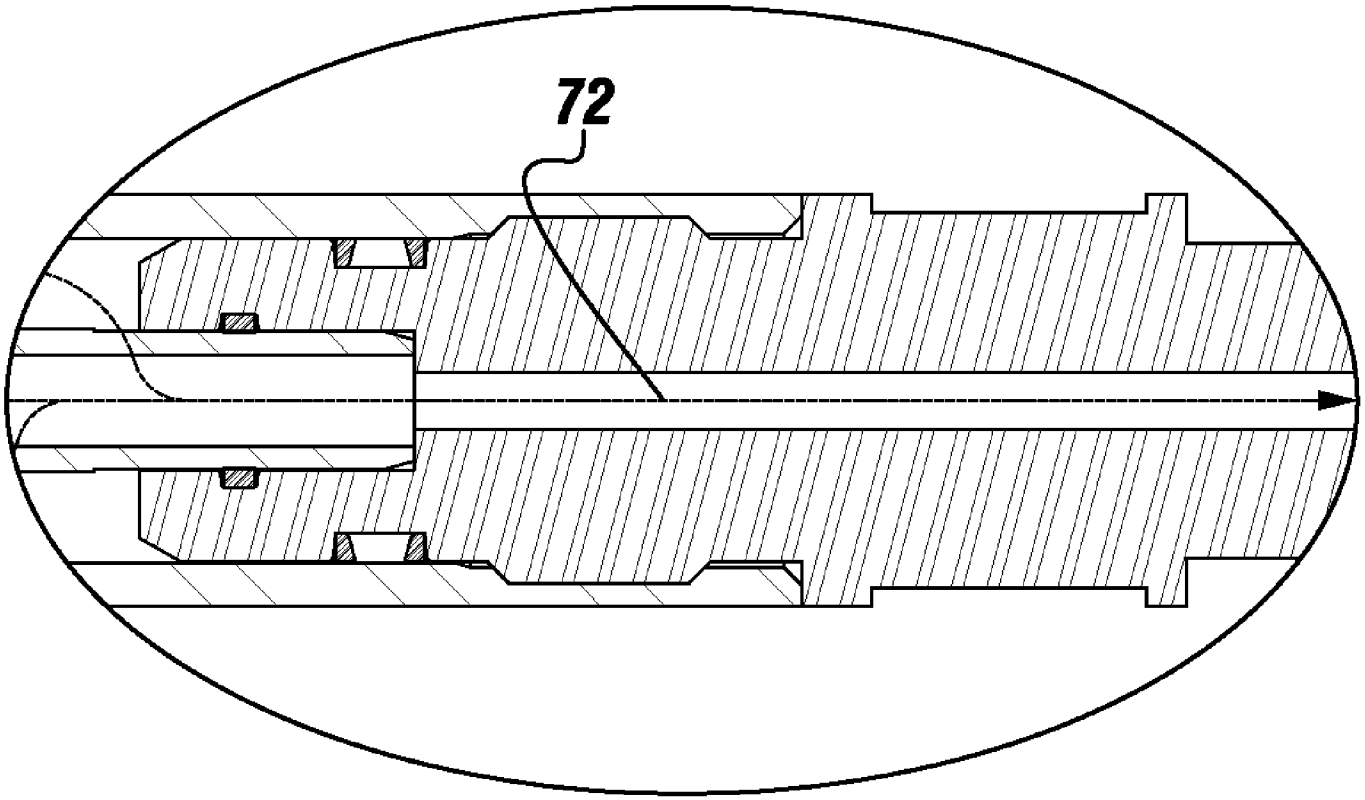

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a downhole filter for hydraulic control lines.

The downhole filter can include a filter housing.

A top filter can be disposed within the filter housing. The top filter can be disposed adjacent a top flow control device housing. The top filter can be a powder metal, wire mesh, composite, or other downhole filter.

The top filter can have an inner bore that can be in fluid communication with an outer diameter of the top filter and with a first portion of the filter housing, such that fluid can flow from the first portion of the filter housing, can filter through the top filter, and can flow into the inner bore of the top filter. The fluid can be hydraulic fluid, water, or other downhole fluids.

A top flow control device housing can be disposed within the filter housing. The top flow control device housing can be disposed in the first portion of the filter housing.

The top flow control device housing can be connected to the top filter. For example, the top flow control device housing can be threaded to a portion of the top filter. A seal can be disposed between the top filter and the top flow control device housing, providing a sealing engagement between the top flow control device housing and the top filter.

The top flow control device housing can include a top flow control device. The top flow control device can be a burst disk and module, a pressure relief valve, a solenoid valve, or another downhole flow control device.

The top flow control device housing can be in fluid communication with the first portion of the filter housing, such as through a top communication port disposed in the top flow control device housing.

When the top filter is clogged or is otherwise blocking the flow of fluid through the top filter into the inner bore of the top filter, the top flow control device can be actuated. For example, pressure from fluid within the first portion of the filter housing can increase if the filter is clogged, and the increased pressure of the fluid can be applied to the top flow control device, such as a burst disk or pressure relief valve, and the flow control device can thereby be actuated.

The downhole filter can include a middle sub that can be in fluid communication with the inner bore of the top filter, such as through an inner bore of the middle sub. The middle sub can be disposed within the filter housing and can be in fluid communication with a second portion of the filter housing, such as through a cross-over bore.

A seal can be disposed between the middle sub and an inner diameter of the filter housing, thereby providing a sealing engagement between the middle sub and the filter housing.

A seal can be disposed between the middle sub and the top filter, thereby providing a sealing engagement between the middle sub and the top filter.

A first end of the middle sub can have an inner bore. The middle sub can have a cross-over formed therein to provide fluid communication between the inner bore of the middle sub and the second portion of the filter housing.

The downhole filter can include a bottom filter that can be disposed within the filter housing, such as within a second portion of the filter housing.

The bottom filter can be connected to the middle sub. A seal can be disposed between the middle sub and the bottom filter, thereby providing a sealing engagement between the middle sub and the bottom filter.

The bottom filter can have an inner bore. The inner bore can be in fluid communication with an outer diameter of the bottom filter and the second portion of the filter housing; thereby allowing a fluid to flow from the second portion of the filter housing, filter through the bottom filter, and flow into the inner bore of the bottom filter.

The downhole filter can include a bottom flow control device housing that can be disposed within the filter housing, such as within the second portion of the filter housing.

The bottom flow control device housing can be connected to the bottom filter. A seal can be disposed between the bottom filter and the bottom flow control device housing; providing a sealing engagement between the bottom flow control device housing and the bottom filter. The bottom flow control device housing can be connected to a second end of the middle sub, such as with a sliding engagement.

The bottom flow control device housing can include a bottom flow control device. The bottom flow control device and the top flow control device can be any downhole flow control device.

The bottom flow control device housing can be in fluid communication with the second portion of the filter housing, such as through a bottom communication port disposed in the bottom flow control device housing.

When the bottom filter is clogged or is otherwise blocking the flow of fluid through the bottom filter into the inner bore of the bottom filter, pressure of the fluid within the second portion of the filter housing can increase. The increased pressure of the fluid can be applied to the bottom flow control device to actuate the bottom flow control device. For example, the bottom flow control device can be a burst disk that can burst from the applied pressure. When the bottom flow control device actuates, a flow path can open between the second portion of the filter housing and the inner bore of the bottom filter, such as through the bottom communication port, thereby bypassing the bottom filter.

In one or more embodiments, threads can be formed or disposed on an outer diameter of at least a portion of the middle sub, and threads can be formed or disposed on at least a portion of an inner diameter of the bottom flow control device housing. The middle sub can be threadably connected to the bottom flow control device housing.

In one or more embodiments, a top sub can be in fluid communication with the first portion of the filter housing. A flow path can be formed from the top sub, into the first portion of the filter housing, and through the top filter in fluid communication with the inner bore of the top filter.

The top sub can have a first end connected to the first portion of the filter housing adjacent the top flow control device housing. The top sub can have a second end connected to a control line. The second end of the top sub can have a jam nut or a quick connect for securing the control line to the second end of the top sub.

In one or more embodiments, a bottom sub can be in fluid communication with the second portion of the filter housing. A flow path can be formed from the middle sub, into the second portion of the filter housing, through the bottom filter in fluid communication with the inner bore of the bottom filter, and into the bottom sub. The bottom sub can have a first end connected to the second portion of the filter housing adjacent the bottom filter.

In one or more embodiments, a bottom fluid conduit can be in fluid communication with the bottom sub. The bottom sub can have an inner bore for providing fluid communication between the bottom filter and the bottom fluid conduit.

The top sub and the bottom sub can each have an inner bore. The top sub can have a cross-over formed therein to provide fluid communication between the inner bore of the top sub and the first portion of the filter housing.

In one or more embodiments, the top filter and the bottom filter can be metal filters that can be concentrically disposed within the filter housing. The top filter and the bottom filter can be configured to filter particulates of at least six microns in diameter, or as small as one micron in diameter.

In one or more embodiments, a first flow path can be formed between the first portion of the filter housing and the inner bore of the top filter through the top filter. A second flow path can be formed between the top flow control device housing and the inner bore of the top filter. The top flow control device can block the second flow path until the top flow control device actuates.

In one or more embodiments, a third flow path can be formed between the second portion of the filter housing and the inner bore of the bottom filter through the bottom filter. A fourth flow path can be formed between the bottom flow control device housing and the inner bore of the bottom filter. The bottom flow control device can block the fourth flow path until the bottom flow control device actuates.

In one or more embodiments, each flow control device housing can have a flow hole or a communication port formed therethrough that can be in fluid communication with the filter housing. The flow hole of the top flow control device can be in fluid communication with the inner bore of the top filter when the top flow control device actuates. The flow hole of the bottom flow control device can be in fluid communication with the inner bore of the bottom filter when the bottom flow control device is actuated.

In one or more embodiments, the top sub can be any hydraulic tubular for hydraulic downhole applications. In one or more embodiments, the bottom sub can be any hydraulic tubular for hydraulic downhole applications.

Turning now to the Figures, FIG. 1 shows an embodiment of the downhole filter 10. The downhole filter 10 can have a filter housing 12.

A top flow control device housing 14*a* can be disposed in the filter housing 12. The top flow control device housing 14*a* can have a top flow control device, here shown as a top burst disk 16*a* with a top burst disk module 15*a*.

A top filter 18 can be disposed within the filter housing 12. The top filter 18 can have an inner bore 20 in fluid communication with an outer diameter of the top filter 18 and a first portion 22 of the filter housing 12.

The downhole filter 10 can have a middle sub 24 with a first end 26 disposed adjacent to the top filter 18.

The middle sub 24 can be in fluid communication with the inner bore 20 of the top filter 18 and with a second portion 28 of the filter housing 12.

Turning now to the Figures, FIGS. 1A, 1B, 1C and 1D show an embodiment of the downhole filter 10. The downhole filter 10 can have a filter housing 12.

A bottom flow control device housing 14*b* can be connected to a second end 30 of the middle sub 24.

The bottom flow control device housing 14*b* can have a bottom flow control device, here shown as a bottom burst disk 16*b* with a bottom burst disk module 15*b*.

A bottom filter 32 can be disposed within the filter housing 12 adjacent the bottom flow control device housing 14*b*.

The bottom filter 32 can include an inner bore 34 in fluid communication with an outer diameter of the bottom filter 32 and the second portion 28 of the filter housing 12.

The top filter 18 can connect to the top flow control device housing 14*a*. A seal 36 can be disposed between the top filter 18 and the top flow control device housing 14*a*.

The top filter 18 can connect to the middle sub 24. A seal 38 can be disposed between the top filter 18 and the middle sub 24.

Threads 40 can be disposed on an outer diameter of at least a portion of the second end of the middle sub 24 for threadably connecting the middle sub 24 to the bottom flow control device housing 14*b*.

A seal 44 can be disposed between the middle sub 24 and the filter housing 12.

The bottom filter 32 can connect to the bottom flow control device housing 14*b*. A seal 46 can be disposed between the bottom filter 32 and the bottom flow control device housing 14*b*.

The bottom filter 32 can connect to a bottom sub 48. A seal 50 can be disposed between the bottom filter 32 and the bottom sub 48. A seal 51 can be disposed between the bottom sub 48 and the filter housing 12.

The bottom sub 48 can have an inner bore 49 in fluid communication with the inner bore 34 of the bottom filter 32.

A top sub 52 can connect to the top flow control device housing 14*a*. A seal 54 can be disposed between the top sub 52 and the filter housing 12, providing a sealing engagement.

The top sub 52 can have an inner bore 53 and a cross-over bore 55, which can both be in fluid communication with the first portion 22 of the filter housing 12.

FIGS. 2A, 2B, 2C and 2D depict an embodiment of the downhole filter 10 showing various flow paths.

A first flow path 69 can be formed between the first portion of the filter housing and the inner bore of the top filter through the top filter.

A second flow path 62 can be formed between the top flow control device housing and the inner bore of the top filter, wherein the top flow control device blocks the second flow path until the top flow control device actuates or bursts.

A third flow path 64 can be formed between the middle sub, the second portion of the filter housing, and the inner bore of the bottom filter through the bottom filter.

A fourth flow path 66 can be formed between the bottom flow control device housing and the inner bore of the bottom filter. The bottom flow control device can block the fourth flow path 66 until the bottom flow control device actuates or bursts.

The top sub can be connected to a control line 68, such as with a jam nut, for securing the control line to the top sub. The control line 68 can be in fluid communication with the inner bore of the top sub.

A bottom fluid conduit 70 can be in fluid communication with the bottom sub and can be connected to the bottom sub, such as with a jam nut. The bottom fluid conduit 70 can be in fluid communication with the inner bore of the bottom sub.

Top communication ports 74*a* and 74*d*, or flow holes, can be formed through the top flow control device housing and can be in fluid communication with the first portion of the filter housing. The top communication ports 74*a* and 74*d* can be in fluid communication with the inner bore of the top filter when the top flow control device bursts.

Bottom communication ports 74*g* and 74*j*, or flow holes, can be formed through the bottom flow control device housing and can be in fluid communication with the second portion of the filter housing. The bottom communication ports 74*g* and 74*j* can be in fluid communication with the inner bore of the bottom filter when the bottom flow control device bursts.

The fluid can exit the downhole filter along an exit flow path 72.

With reference to FIGS. 1A, 1B, 1C and 1D and FIGS. 2A, 2B, 2C and 2D, operation of one or more embodiments will be described below.

In operation, the fluid can flow through the first portion 22 of the filter housing 12, such as from the top sub 52. The fluid can flow from the first portion 22 through the top filter 18 and into the inner bore 20. The fluid can then flow from the inner bore 20, into the middle sub 24, and into the second portion 28 of the filter housing 12. The fluid can flow from the second portion 28, through the bottom filter 32, and into the inner bore 34. From the inner bore 34, the fluid can exit the downhole filter 10, such as into the bottom sub 48.

During operation, if the top filter 18 gets clogged or otherwise is not allowing fluid to flow therethrough, the pressure of the fluid within the first portion 22 can increase. As the pressure of the fluid within the first portion 22 increases, the pressure can be exerted upon the top flow control device, which is shown as a top burst disk 16*a* and a top burst disk module 15*a*, which can actuate or burst under the pressure. When the top flow control device, which is shown as a top burst disk 16*a* and a top burst disk module 15*a* bursts, the second flow path 62 can be opened, thereby bypassing the top filter 18 when the top filter is clogged.

During operation, if the bottom filter 32 gets clogged or otherwise is not allowing fluid to flow therethrough, the pressure of the fluid within the second portion 28 can increase. As the pressure of the fluid within the second portion 28 increases, the pressure can be exerted upon the bottom flow control device, which is shown as a bottom burst disk 16*b* and a bottom burst disk module 15*b*, which can actuate or burst under the pressure. When the bottom flow control device, which is shown as a bottom burst disk 16*b* and a bottom burst disk module 15*b* bursts, the fourth flow path 66 can be opened, thereby bypassing the bottom filter 32 when the bottom filter is clogged.

The middle sub 24 allows for the bottom filter 32 with the bottom flow control device housing 14*b* to be installed within the filter housing 12 and used therein, thereby providing a downhole filter 10 having two filters, a top filter 18 and a bottom filter 32 and two flow control device housings, a top flow control device housing 14*a* and a bottom flow control device housing 14*b* disposed within a single filter housing 12.

Figure 3A:
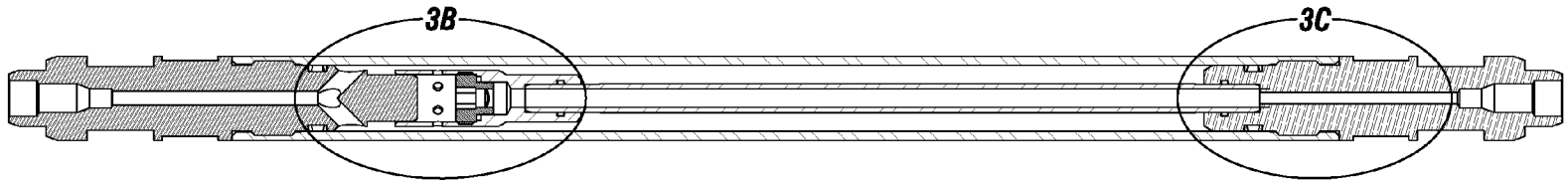
FIGS. 3A, 3B and 3C depict another embodiment of the downhole filter.
Figure 3C:
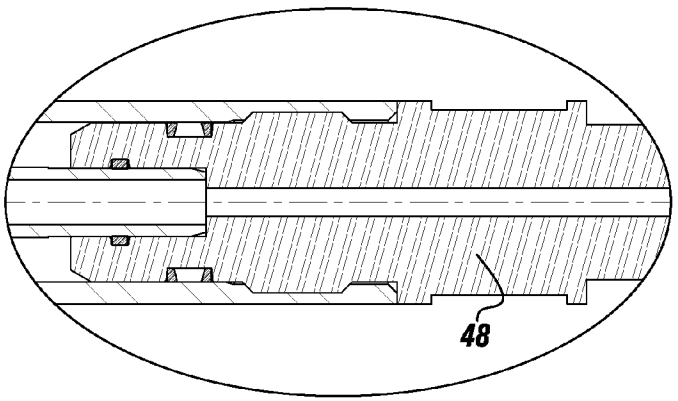
Figure 3B:
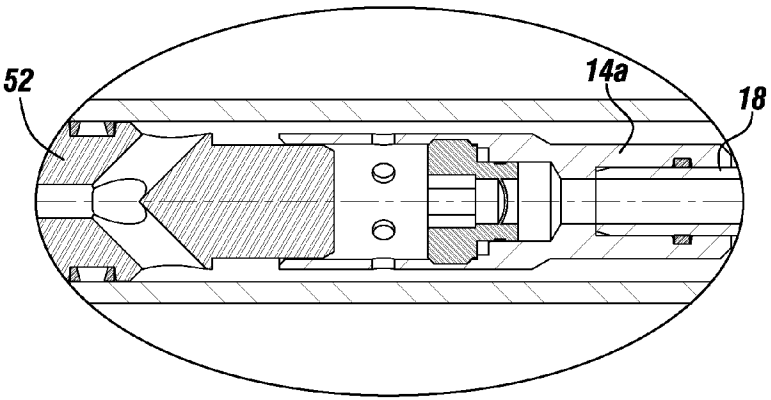

FIGS. 3A, 3B and 3C depict another embodiment of the downhole filter 10 with a top filter 18 in fluid communication with the bottom sub 48. The top filter 18 can be connected directly to the bottom sub 48. The top filter 18 can also be connected to the top flow control device housing 14*a*. The top flow control device housing 14*a* can be connected to the top sub 52.

While these embodiments have been described with emphasis on the embodiments, it should be understood that within the scope of the appended claims, the embodiments might be practiced other than as specifically described herein.

What is claimed is:

1. A downhole filter comprising:

a. a filter housing;

b. a top flow control device housing disposed in the filter housing, wherein the top flow control device housing has a flow control device disposed therein;

c. a top filter disposed within the filter housing adjacent the top flow control device housing, wherein the top filter comprises an inner bore in fluid communication with an outer diameter of the top filter and a first portion of the filter housing;

d. a middle sub having a first end disposed adjacent to the top filter, wherein the middle sub provides a flow path between the inner bore of the top filter and a second portion of the filter housing, wherein a cross-over formed into the middle sub provides fluid communication between the inner bore of the middle sub and the second portion of the filter housing;

e. a bottom flow control device housing connected to a second end of the middle sub, wherein the bottom flow control device housing comprises a bottom flow control device;

f. a bottom filter adjacent the bottom flow control device housing, wherein the bottom filter comprises an inner bore in fluid communication with an outer diameter of the bottom filter and the second portion of the filter housing;

g. a top sub having a first end connected to the first portion of the filter housing adjacent the top flow control device housing; and h. a bottom sub having a first end connected to the second portion of the filter housing adjacent the bottom filter.

2. The downhole filter of claim 1, further comprising threads disposed on an outer diameter of at least a portion of the middle sub, and threads formed on at least a portion of an inner diameter of the bottom flow control device housing, wherein the middle sub is threadably connected to the bottom flow control device housing.

3. The downhole filter of claim 1, wherein the top filter is a metal filter concentrically disposed within the filter housing and is configured to filter particulates of at least one micron in diameter.

4. The downhole filter of claim 1, wherein the top flow control device selectively allows fluid communication between the inner bore of the top filter and a top sub.

5. The downhole filter of claim 1, wherein the bottom flow control device selectively allows fluid communication between the inner bore of the bottom filter and the middle sub.

6. The downhole filter of claim 1, wherein the top sub has a second end connected to a control line.

7. The downhole filter of claim 6, wherein the second end of the top sub comprises a jam nut for securing the control line to the second end of the top sub.

8. The downhole filter of claim 1, further comprising a bottom fluid conduit in fluid communication with the bottom sub.

9. The downhole filter of claim 8, wherein the bottom sub comprises an inner bore for providing fluid communication between the bottom filter and the bottom fluid conduit.

10. The downhole filter of claim 1, wherein the first end of the middle sub has an inner bore.

11. The downhole filter of claim 1, wherein the top flow control device housing has a flow hole formed therethrough in fluid communication with the first portion of the filter housing.

12. The downhole filter of claim 11, wherein the flow hole is in fluid communication with the inner bore of the top filter when the top flow control device bursts.

13. The downhole filter of claim 1, wherein the bottom flow control device housing has a flow hole formed therethrough in fluid communication with the second portion of the filter housing.

14. The downhole filter of claim 13, wherein the flow hole is in fluid communication with the inner bore of the bottom filter when the bottom flow control device bursts.

* * * * *